US008126386B2

(12) United States Patent
Hara

(10) Patent No.: US 8,126,386 B2
(45) Date of Patent: Feb. 28, 2012

(54) SHEET FEEDER, IMAGE FORMING APPARATUS AND SHEET FEEDER CONTROL METHOD

(75) Inventor: Kazuhiro Hara, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 846 days.

(21) Appl. No.: 11/782,054

(22) Filed: Jul. 24, 2007

(65) Prior Publication Data

US 2008/0025776 A1 Jan. 31, 2008

(30) Foreign Application Priority Data

Jul. 27, 2006 (JP) ..... 2006-205438

(51) Int. Cl.
*G03G 15/00* (2006.01)
*B65H 5/00* (2006.01)

(52) U.S. Cl. ..... 399/388; 271/10.13

(58) Field of Classification Search ..... 399/361, 399/388; 271/10.13, 114
See application file for complete search history.

(56) References Cited

U.S. PATENT DOCUMENTS

| | | | | |
|---|---|---|---|---|
| 4,629,173 | A * | 12/1986 | Hashimoto et al. | 271/65 |
| 6,834,850 | B2 * | 12/2004 | Fukuchi | 271/10.11 |
| 7,354,346 | B2 * | 4/2008 | Takada et al. | 464/10 |
| 2005/0179192 | A1 * | 8/2005 | Miura et al. | 271/118 |

FOREIGN PATENT DOCUMENTS

| | | | |
|---|---|---|---|
| JP | 04-292350 | | 10/1992 |
| JP | 08-015786 | | 1/1996 |
| JP | 08015786 | A * | 1/1996 |
| JP | 09-278225 | | 10/1997 |
| JP | 11-352820 | | 12/1999 |
| JP | 2003-155138 | | 5/2003 |

OTHER PUBLICATIONS

Japanese Office Action dated Dec. 28, 2010 corresponding to U.S. Appl. No. 11/782,054, filed Jul. 24, 2007.

* cited by examiner

*Primary Examiner* — Daniel J Colilla
*Assistant Examiner* — Allister Primo
(74) *Attorney, Agent, or Firm* — Turocy & Watson, LLP

(57) ABSTRACT

A sheet feeder includes a sheet feed roller provided at a position of the upstream side of an aligning roller along the sheet conveying direction, a clutch to transmit and cut off the driving force from a driving source to rotate the feed roller, a rotary shaft connected to the clutch in the rotatable state, a torque limiter provided on the rotary shaft, and an inertial member provided to the rotary shaft via the torque limiter.

10 Claims, 5 Drawing Sheets

SHEET FEEDER, IMAGE FORMING APPARATUS AND SHEET FEEDER CONTROL METHOD

CROSS-REFERENCE TO RELATED APPLICATION

This application is based upon and claims the benefit of priority from the prior Japanese Patent Application No. 2006-205438 filed on Jul. 27, 2006, the entire contents of which are incorporated herein by reference

BACKGROUND

1. Field of the Invention

The present invention relates to a sheet feeder, an image forming apparatus, and a sheet feeder control method.

2. Description of the Related Art

Generally, an image forming apparatus such as a copying machine is equipped with roller pairs which are called as aligning rollers. These aligning rollers are provided at a position of the upstream side in the conveying direction of an image forming apparatus (an unit to transfer a toner image on sheets conveyed using a photosensitive drum, etc.) and functions to correct the oblique ends of sheets conveyed from the sheet feeder.

The aligning rollers are rotated to properly correct sheets conveyed obliquely by bending sheets fed from the sheet feeder at the nip position by putting them to the nip position of the aligning rollers which are kept stopped to rotate and to send out the sheets at an optimum timing to transfer a toner image on the sheets at the image forming unit as described above.

The sheet feeder is provided at the upper-stream side in the conveying direction of the aligning rollers; however, feed rollers may be provided at the upper-stream side of the aligning rollers in the relation of the length of the conveying path from the sheet feeder to the aligning rollers. These feed rollers are to convey sheets supplied from the sheet feeder to the aligning rollers; but the aligning rollers are first in the rotation stopped state as described above, and for the reason that a prescribed flexion is formed on sheets, the feed rollers are stopped to rotate at a timing when the flexion formed on sheets by the aligning rollers reaches a specified amount.

This feed roller have no exclusive driving source and use the driving source jointly with other rollers (for example, sheet feed rollers, aligning rollers, etc.) in many cases. Because of this, as disclosed in the Japanese Patent Application Publication No. 2003-155138, the driving power of this feed roller is transmitted from the commonly using driving source via gears, etc. and further, the feed rollers are rotated or stopped using a clutch, etc. In other words, the rotation and stopping of the feed rollers are controlled by the ON/OFF of this clutch.

However, as the rotation/stopping of the feed roller is made by this clutch, when the driving power is transmitted/cut off from the driving source by the clutch, a sudden torque is applied to the driving shaft and vibration is generated. This vibration adversely affects especially the optical unit, the transfer belt, the photosensitive drum, etc. in the image forming apparatus, and gives a jitter to an image. In other words, this vibration is transmitted to a mirror of the optical system and laser light pitch is changed and an electrostatic latent image formed on the photosensitive drum may become uneven.

SUMMARY

It is an object of the present invention to provide a sheet feeder generating less vibration when a clutch is engaged, an image forming apparatus and a sheet feeder control method.

According to the embodiment of the present invention, there is provided a sheet feeder comprising a sheet feed roller provided at a position of the upstream side of an aligning roller along the sheet conveying direction; a clutch to transmit and cut off the driving force from a driving source to rotate the feed roller; a rotary shaft connected to the clutch in the rotatable state; a torque limiter provided on the rotary shaft; and an inertial member provided to the rotary shaft via the torque limiter.

According to the embodiment of the present invention, there is provided an image forming apparatus, comprising an image carrying body; a developing unit to form a developer image on the image carrying body; a transferring unit to transfer the developer image onto a sheet from the image carrying body; and a sheet feeder to feed the sheet to the transferring unit, wherein the sheet feeder including: a sheet feed roller provided at a position of the upstream side of an aligning roller along the sheet conveying direction; a clutch to transmit and cut off the driving force from a driving source to rotate the feed roller; a rotary shaft connected to the clutch in the freely rotatable state; a torque limiter provided on the rotary shaft; and an inertial member provided to the rotary shaft via the torque limiter.

According to the embodiment of the present invention, there is provided a control method of a sheet feeder including a sheet feed roller provided at a position of the upstream side of an aligning roller along the sheet conveying direction, a driving source to rotate the sheet feed roller, a clutch to transmit and cut off the driving force from the diving source, a rotary shaft connected to the clutch and provided in the rotatable state, a torque limiter provided on the rotary shaft, and an inertial member provided to the rotary shaft via the torque limiter, comprising making the first clutch engagement; disengaging the clutch; and making the second clutch engagement.

DETAILED DESCRIPTION OF THE EMBODIMENTS

Hereinafter, the embodiments of the present invention will be described with reference to the attached drawings.

Figure 1:
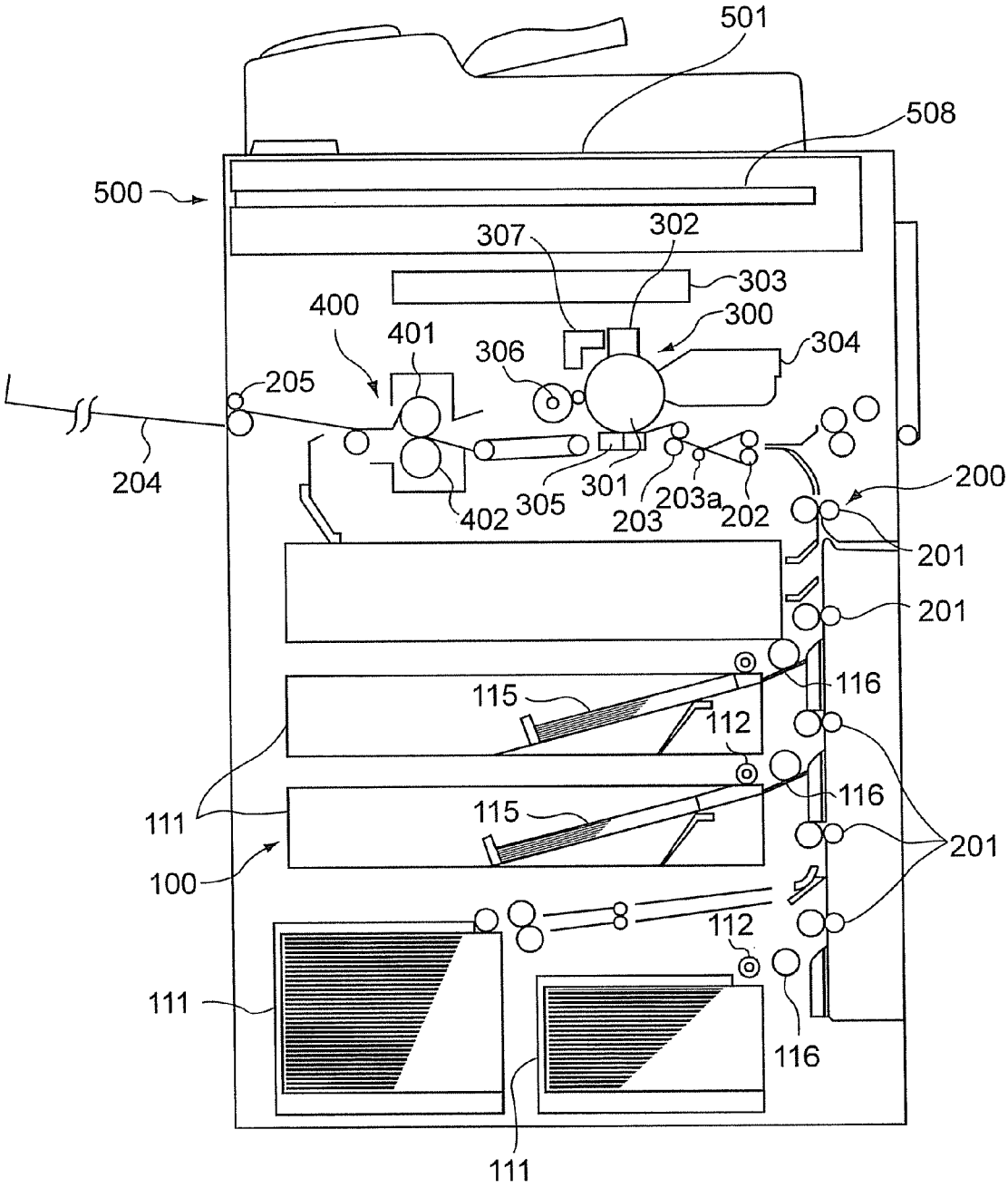
FIG. 1 is a schematic cross-sectional view of the image forming apparatus involved in the first embodiment of the present invention.

FIG. 1 is a schematic diagram of the image forming apparatus in a first embodiment of the present invention. The image forming apparatus comprises a sheet feeder 100 provided at the lower part of a main body 1, a sheet conveying portion 200 provided at the side and the upper portion of sheet feeder 100, an image forming unit 300 provided on the upper part of sheet conveying unit 200, a fixing unit 400 provided at the discharging side from image forming unit 300, and a image reading unit 500 which comprises optical system members arranged above these image forming unit 300 and fixing unit 400.

Sheet feeder 100 sends out a sheet 115 to the exit side of a sheet cassette 111 (the right side in FIG. 1) by the rotating action of a sheet feed roller 112 from sheet cassette 111 selected from 4 sheet cassettes 111 and separate sheets each other by a separation pad 117 provided at the upper portion of both ends in the width direction of sheet cassette 111, and feeds sheet 115 at the top position one by one certainly. Further, these 4 sheet cassettes 111 is in the structure that sheet can be freely pulled out for main body 1.

Sheet conveying portion 200 conveys sheet 115 supplied from sheet feeder 100 toward image forming unit 300 by a conveying roller 201, a sheet feed roller 202 (a conveying roller at the lowest-stream side in conveying rollers and an aligning roller 203, and further, discharges sheet 115 with the image forming made in fixing unit 400 on a sheet receiving tray 204 by an exit roller 205 from image forming unit. Conveying roller 201, sheet feed roller 202, aligning roller 203 and exit roller 205 are composed by a pair of rollers, respectively. In front of aligning roller 203, an aligning roller sensor 203*a* is arranged so as to turn ON/OFF according to the conveyance of sheet 115. The ON/OFF signal of aligning sensor 203*a* is sent to a control means that is not shown in FIG. 1.

Aligning roller 203 is provided at the upper-stream side in the conveying direction of image forming unit 300 and functions to correct the oblique end of sheet 115 conveyed from sheet feeder 100 and convey sheet 115 at an optimum timing to transfer a toner image on sheet 115. Therefore, aligning roller 203 is driven by power transmitted from the driving source through the gear and the clutch and at the time when sheet 115 is conveyed, aligning roller 203 is stopped to rotate and the end of conveyed sheet 115 is brought to contact the nip portion of aligning roller 203, forming a bend at the end of sheet and then, sheet 115 is conveyed to image forming unit 300 by rotating aligning roller 203.

As described above, in order to form a proper flexion on sheet 115 by aligning roller 203, the rotation and stopping of sheet feed roller 202 provided at a position of the upstream side of aligning roller 203 along the sheet conveying direction are important functions. The driving force is transmitted to sheet feed roller 202 from the driving source (not shown) by way of various gears and the clutch, and at the time when sheet 115 is conveyed. Sheet feed roller 202 is rotating (the driving force is transmitted from a driving source when the clutch is turned ON) and is rotating continuously until a specified flexion is formed on the end of the sheet 115. When the specified flexion is formed on sheet 115 by aligning roller 203 (after a specified time passed from the turn ON of aligning roller 203), the sheet feed roller 202 stops to rotate (the driving force from the driving source is shut off when the clutch is turned OFF). The definite structure of sheet feed roller 202 and the clutch will be described later.

Image forming unit 300 forms a toner image on sheet 115 and is comprising photosensitive drum 301 as an image carrying body which has photo-conductivity and is rotatably supported, with a charging unit 302, an exposure unit 303, a developing unit 304, a transferring unit 305, a cleaner 306 and a neutralization unit 307 arranged around photosensitive drum 301 in its rotating direction.

Charging unit 302 is provided with a charging wire to which high voltage is applied and a specified potential is given to the surface of photosensitive drum 301 by the corona discharge from this charging wire. Exposure unit 303 irradiates the laser light output from a laser luminous organ based on an image data of a manuscript read by an image reading unit 500 which is described later to photosensitive drum 301 through a polygon mirror and a reflecting mirror. An electrostatic latent image is thus formed on the surface of photosensitive drum 301 by selectively attenuating the potential on its surface. Developing unit 304 develops the electrostatic latent image using a toner and forms a toner image or a developer image on the surface of photosensitive drum 301. Transferring unit 305 transfers the toner image formed on the surface of photosensitive drum 301 on sheet 115. In this image forming apparatus, transferring unit 305 is composed of transfer rollers which are separated by a specified distance from photosensitive drum 301. Cleaner 306 removes toner remained on the surface of photosensitive drum 301 after transferring an image. Neutralization unit 307 removes residual charge on the surface of photosensitive drum 301.

Fixing unit 400 is arranged at the down-stream side of image forming unit 300 in the sheet conveying direction and fixes a toner image transferred on the sheet in image forming unit 300 thereon by clamping and heating the sheet with heating roller 401 and a pressing roller 402 which is pressed against this heating roller 401.

image reading unit 500 irradiates the light from an exposure lamp to a document placed on a contact glass 501 and reads image data of the document by leading the reflecting light to a photoelectric converter that is comprising a CCD line sensor, etc. Further, the exposure lamp and the reflecting mirror form a scanning movement unit and it is possible to read an image on the whole surface of a document by scanning the whole surface of a document placed on contact glass 501 when this scanning movement unit moves a moving area 508 in the left and right directions in FIG. 1 at a specified speed.

Figure 2:
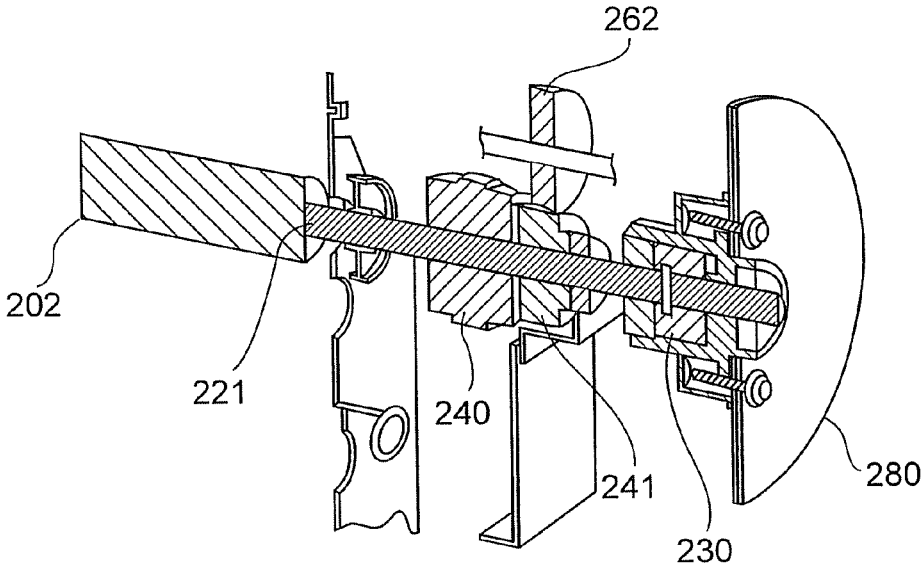
FIG. 2 is a cross-sectional prospective view of the surrounding part of the feed roller involved in the first embodiment of the present invention.
Figure 3:
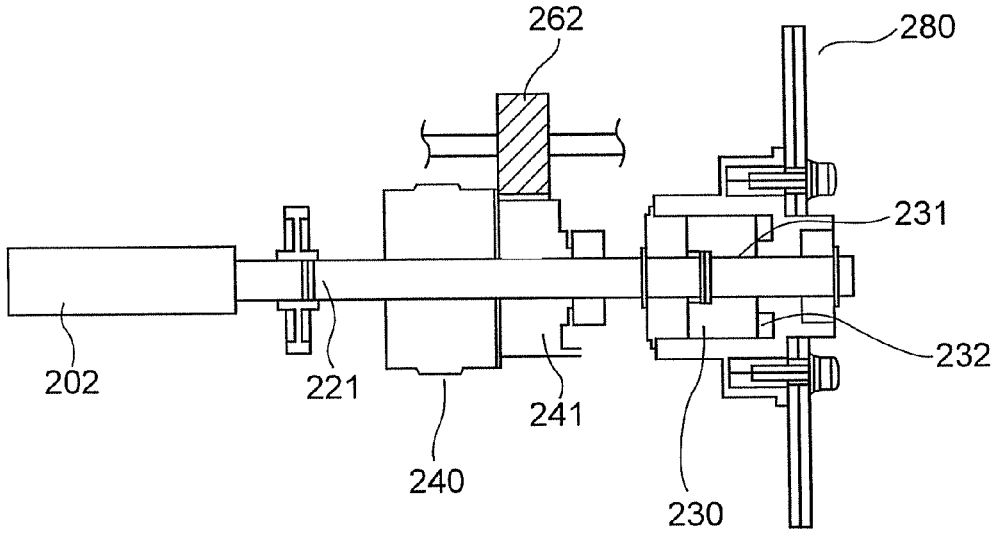
FIG. 3 is a cross-sectional view of the surrounding part of the feed roller involved in the first embodiment of the present invention.

Next, the definite construction of sheet feed roller 202 and its surrounding will be explained with reference to FIG. 2 and FIG. 3. FIG. 2 is a perspective cross-sectional view of the feed roller and its surrounding area in the first embodiment. FIG. 3 is a cross-sectional view of the feed roller and its surrounding area in the first embodiment of the present invention.

Sheet feed roller 202 is driven to rotate by rotary shaft 221 which is extending in the longitudinal direction. Rotary shaft 221 is provided with an electromagnetic clutch 240 which transmits and shut off the driving force. Further, at the position opposite to a clutch gear 241 of electromagnetic clutch 240, there is a drive gear 262 provided, to which the drive force from the drive source is transmitted. When a clutch gear 241 of electromagnetic clutch 240 meshes with drive gear 262 and the witch of electromagnetic clutch 240 is turned ON, electromagnetic clutch 240 is engaged and the drive force is transmitted to rotary shaft 221.

Further, rotary shaft 221 is provided with a torque limiter 230 and a flywheel 289 is mounted in the freely rotatable state through this torque limiter 230. Torque limiter 230 has an inner ring 231 and an outer ring 232. Inner ring 231 is fixed to rotary shaft 221, while outer ring 232 is fixed to flywheel 280. These rings are fixed according to known methods such as screwing, press fitting, adhesion, etc. In this embodiment, the screwing is used.

Inner ring 231 and outer ring 232 of torque limiter 230 are always connected each other at a specified connecting force of the magnetic force or springs, and a torque limiter in such a structure that when rotary torque more than a certain level is given in the sheet conveying direction, the connecting force is weakened is used.

Accordingly, if the driving force is transmitted to rotary shaft 221 at a rotating torque more than a specified value from the driving source, the driving force higher than the upper limit value of torque limiter 230 is not transmitted o flywheel 280.

Figure 4:
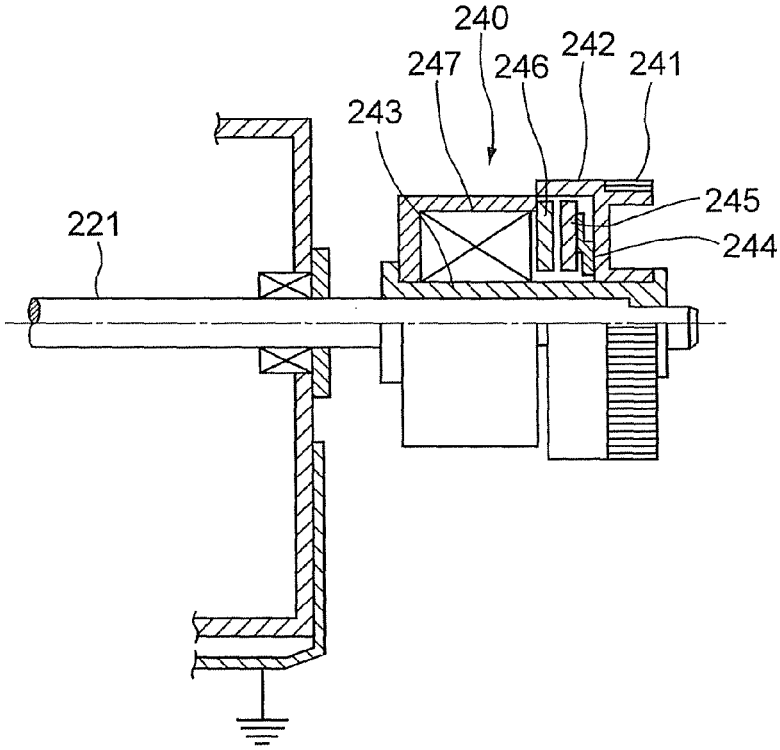
FIG. 4 is a sectional view of the electromagnetic clutch involved in the first embodiment of the present invention.

Next, electromagnetic clutch 240 will be explained with reference to FIG. 4. FIG. 4 is a cross-sectional view of the electromagnetic clutch involved in the first embodiment of the present invention. In electromagnetic clutch 240, a cylinder portion 242 that is in one unit with clutch gear 241 is freely fitted to a hollow shaft 243 that is fixed to rotary shaft 221, and an armature 245 is provided in cylinder portion 242 via a blade spring 244. Further, a rotor 246 and electromagnetic coil 247 are fixed to hollow shaft 243 opposing to armature 245. When current flows to this electromagnetic coil 247, armature 245 is pulled to rotor 246 by the magnetic force and the driving force of clutch gear 241 is transmitted to rotary shaft 221.

Thereafter, current flows to magnetic coil 247 and armature 245 is pulled to rotor 246 by the magnetic force and the driving force of clutch gear 241 is kept being transmitted to rotary shaft 247. This is the state where electromagnetic clutch 24 is ON. Further, when the flow of current to electromagnetic coil 247 is stopped, and armature 245 and rotor 246 which are pulled to each other by the magnetic force is separated and the driving of clutch gear 241 with rotary shaft 221 is shut off. This is the state where electromagnetic clutch 24 is turned OFF.

Figure 5:
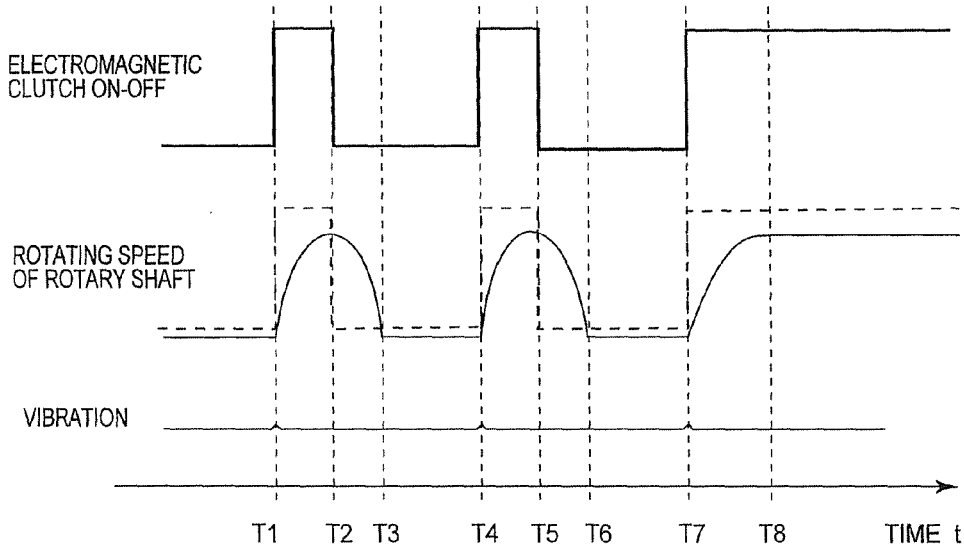
FIG. 5 is a time chart relative to the vibration of the feed roller at the time when the electromagnetic clutch is engaged in the first embodiment.

In succession, the vibration produced on rotary shaft 221 when electromagnetic clutch 240 is engaged will be explained with reference to FIG. 5. FIG. 5 is a time chart relative to the vibration of the feed roller when the electromagnetic clutch is engaged in the first embodiment.

When clutch 140 is engaged (ON) at a time T1, the driving force is transmitted to rotary shaft 221. Because flywheel 280 that I an inertial member is connected to rotary shaft 221, rotary shaft 221 does not rotate rapidly but begins to rotate slower than when flywheel 280 is not connected. Further, since this flywheel 280 is connected to rotary shaft 221 via torque limiter 230, the rapid generation of torque when electromagnetic clutch 240 is engaged can be suppressed. As a result, the vibration generated on rotary shaft 221 at the time T1 becomes small and the image formation is extremely less influenced. In succession, when electromagnetic clutch 240 is disengaged (OFF) at a time T2, no driving force is received and rotary shaft is rotated gently by the inertial force and stops at a time T3.

Figure 6:
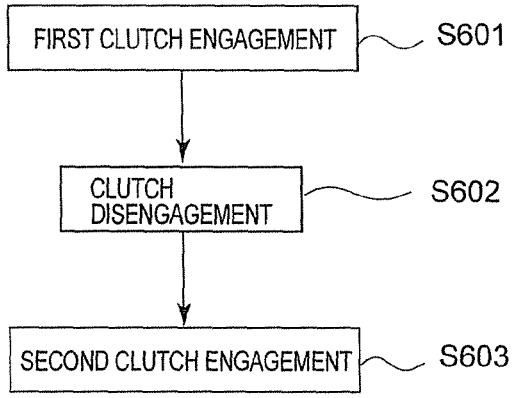
FIG. 6 is a flowchart showing the sheet feeder control method involved in the second embodiment of the present invention.
Figure 7:
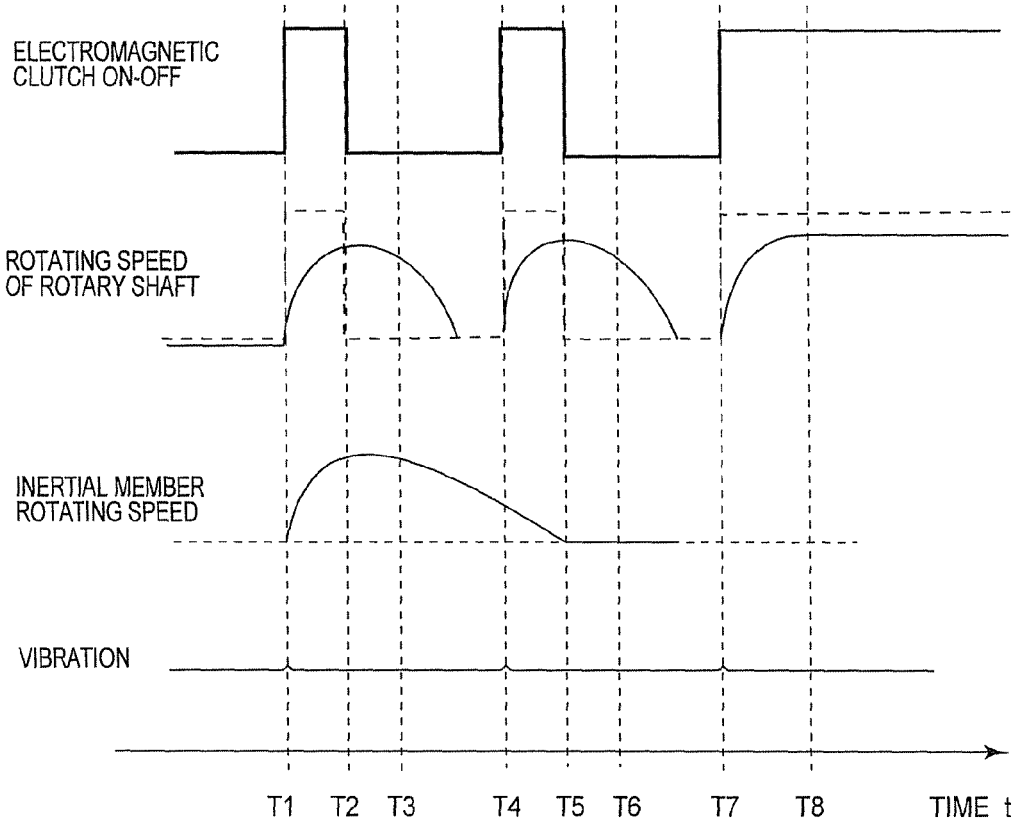
FIG. 7 is a time chart relative to the vibration of the feed roller when the electromagnetic clutch is engaged in the second embodiment of the present invention.

A second embodiment of the present invention will be explained with reference to FIG. 6 and FIG. 7. FIG. 6 is a flowchart showing the sheet feeder control method in the second embodiment of the present invention. FIG. 7 is a time chart relative to the vibration of the feed roller when the electromagnetic clutch is engaged in the second embodiment of the present invention. In this embodiment, such a method is adopted that electromagnetic clutch 240 is once engaged for transmitting the driving force to rotary shaft 221 when driving sheet feed roller 202 (S601) and then, this electromagnetic clutch 240 is disengaged (S602) and thereafter, electromagnetic clutch 240 is again engaged (S603).

At this time, electromagnetic clutch 240 becomes the ON state at Time 1 and Step S601 that is the first clutch engagement is executed as shown in FIG. 7. In succession, electromagnetic clutch 240 becomes the OFF state at Time T2 and the Step S602 that is the disengagement of the clutch) is executed. Here, even after electromagnetic clutch 240 is disengaged and no driving force is received, rotary shaft 221 is rotating slowly by the inertial force.

Then, Step S603 that is the second clutch engagement was executed successively at Time T4, the torque acts in the direction to support the rotation of rotary shaft 221 by the inertial force of flywheel continuously rotating gently when the clutch is engaged. Therefore, the shock given to rotary shaft at the time of engagement is made weak and becomes less than the shock given to stopped rotary shaft 221.

Further, when the number of revolutions of rotary shaft 221 is adequate, it is also possible to provide a supplementary effect when applying the driving force to rotary shaft 221 when engaging electromagnetic clutch 240. Therefore, in a sheet feeder in such structure as that in this embodiment, a good image forming hardly generating the vibration and less jitter is executed.

Regarding a value of rotary load to a feed roller by torque limiter 230, it is possible to select a value appropriately by changing a size of torque limiter 230 by taking a rotary torque values from the driving source. Further, because a time of stopping the rotary shaft from disengaging the clutch by the inertial moment of flywheel 280 and drop in number of revolutions can be calculated, it is possible to provide a sheet feeder of less vibration at the time of engaging the clutch by properly designing torque limiter 230 and flywheel 280.

In the embodiments described above, a copying machine is explained as an example of an image forming apparatus. However, the present invention is also applicable to facsimiles, printers, etc.

Figure 8:
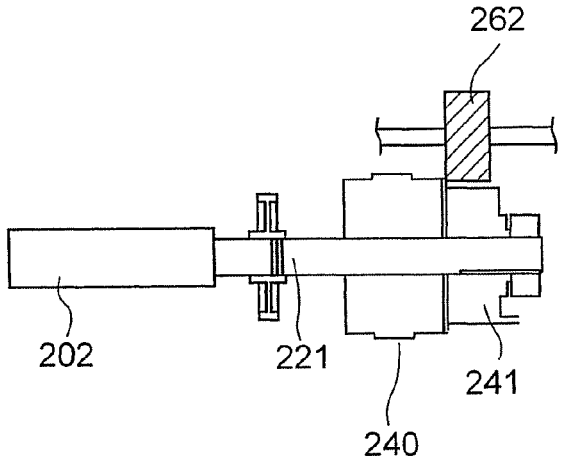
FIG. 8 is a cross-sectional view of the surrounding part of the feed roller in a conventional example.
Figure 9:
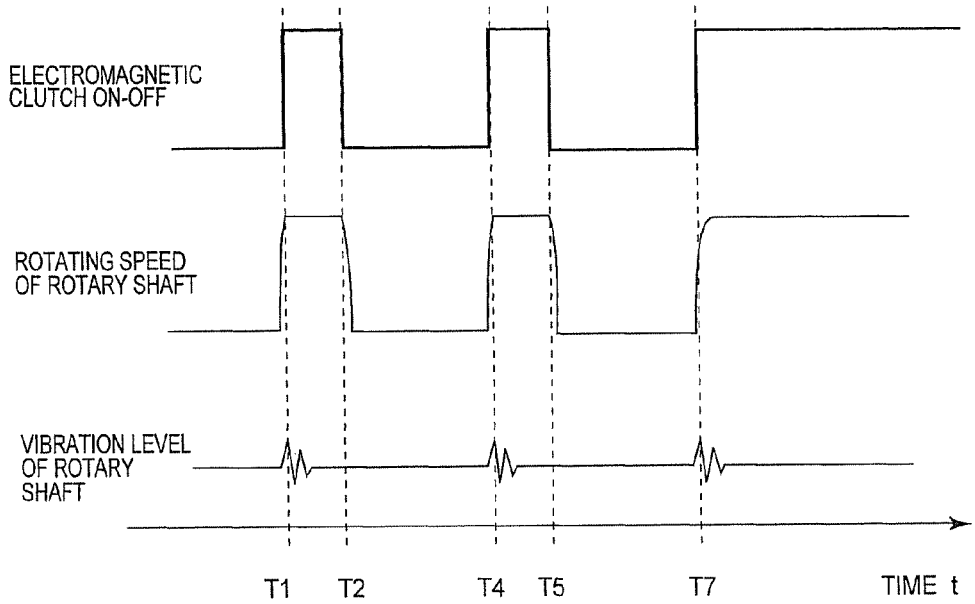
FIG. 9 is a time chart relative to the vibration of the rotary shaft at the time when the magnetic clutch is engaged in a conventional example.

In succession, the vibration that is generated on rotary shaft when the electromagnetic clutch is engaged in a conventional example will be explained with reference to FIG. 8 and FIG. 9. FIG. 8 is a cross-sectional diagram of a feed roller and its surrounding parts in a conventional example. FIG. 9 is a time chart relative to the vibration of the rotary shaft when the electromagnetic clutch is engaged in a conventional example. In a conventional example, there is no flywheel 280 provided via torque limiter 230. When electromagnetic clutch 240 is engaged (ON) at Time T1 for a feed roller in this structure, rotary shaft 221 begins to rotate rapidly by the driving force because flywheel 280 is not connected and the inertia moment is small. By this rapid revolution, the vibration is generated on rotary shaft 221. When electromagnetic clutch 240 is disengaged (OFF) at Time T2, sheet feed roller 202 losses the driving force and stops to rotate at Time T3.

What is claimed is:

1. A sheet feeder comprising:

a sheet feed roller to covey a sheet provided at a position of the upstream side of an aligning roller along the sheet conveying direction;

the aligning roller starts to rotate when a sheet is conveyed;

a clutch to transmit and cut off the driving force from a driving source to rotate the feed roller;

a rotary shaft connected to the clutch in the rotatable state;

an inertial member provided to the rotary shaft; and a torque limiter comprising an inner ring fixed to the rotary shaft and an outer ring fixed to the inertia member, the clutch having further a function to disengage after transmitting the driving force from the driving source to the inertial member by engaging first at the time when feeding sheets and to make a second engagement successively, and a controller that controls the engagement of the clutch at a time T1, when the driving force is transmitted to the rotary shaft causing the sheet feed roller to rotate, disengagement of the clutch at a time T2, when the driving force is transmitted to the inertial member at specified time after the aligning roller is turned on causing specified flexion on the sheet, and the second engagement of the clutch at a time T4, while the inertial member is continuously rotating.

2. The sheet feeder according to claim 1, wherein the inertial member is rotating after disengaging the clutch until making the second engaging.

3. The sheet feeder according to claim 1, wherein the inertial member includes a flywheel.

4. An image forming apparatus, comprising:

an image carrying body;

a developing unit to form a developer image on the image carrying body;

a transferring unit to transfer the developer image onto a sheet from the image carrying body; and a sheet feeder to feed the sheet to the transferring unit, wherein the sheet feeder including:

a sheet feed roller provided at a position of the upstream side of an aligning roller along the sheet conveying direction;

the aligning roller starts to rotate when a sheet is conveyed;

a clutch to transmit and cut off the driving force from a driving source to rotate the feed roller;

a rotary shaft connected to the clutch in the freely rotatable state; an inertial member provided to the rotary shaft;

a torque limiter comprising an inner ring fixed to the rotary shaft and an outer ring fixed to the inertial member, the clutch functions to disengage after transmitting the driving force from the driving source to the inertial member by engaging first at the time when feeding sheets and to make a second engagement successively; and a controller that controls the engagement of the clutch at a time T1, when the driving force is transmitted to the rotary shaft causing the sheet feed roller to rotate, disengagement of the clutch at a time T2, when the driving force is transmitted to the inertial member at specified time after the aligning roller is turned on causing specified flexion on the sheet, and the second engagement of the clutch at a time T4, while the inertial member is continuously rotating.

5. The apparatus according to claim 4, wherein the inertial member is rotating after disengaging the clutch until making the second engaging.

6. The apparatus according to claim 4, wherein the inertial member includes a flywheel.

7. A control method of a sheet feeder including a sheet feed roller provided at a position of the upstream side of an aligning roller along the sheet conveying direction, a driving source to rotate the sheet feed roller, a clutch to transmit and cut off the driving force from the diving source, a rotary shaft connected to the clutch and provided in the rotatable state, an inertial member provided to the rotary shaft, a torque limiter comprising an inner ring fixed to the rotary shaft and an outer ring fixed to the inertial member, the clutch being disengaged after transmitting the driving force from the driving source to the inertial member by the first clutch engagement at the time of sheet feeding and make a second engagement of the clutch, successively, comprising:

transmitting a driving force to the rotary shaft causing the sheet feed roller to rotate and making a first clutch engagement at the time of sheet feeding, disengagement of the clutch at a time T2, when the driving force is transmitted to the inertial member at specified time after the aligning roller is turned on causing specified flexion on the sheet, and making the second engagement of the clutch at a time T4, while the inertial member is continuously rotating.

8. The method according to claim 7, wherein the inertial member is rotating after completing the clutch disengaging until the second clutch engagement is started.

9. A control method of an image forming apparatus comprising: forming a developer on an image carrying body, transferring the developer image onto a sheet from the carrying body at a transferring unit feeding the sheet from a sheet feeder including a sheet feed roller provided at a position of the upstream side of an aligning roller along the sheet conveying direction, a driving source to rotate the sheet feed roller, a clutch to transmit and cut off the driving force from the diving source, a rotary shaft connected to the clutch and provided in the rotatable state, an inertial member provided to the rotary shaft, a torque limiter comprising an inner ring fixed to the rotary shaft and an outer ring fixed to the inertial member, the clutch being disengaged after transmitting the driving force from the driving source to the inertial member by the first clutch engagement at the time of sheet feeding and make a second engagement of the clutch, successively, comprising:

transmitting a driving force to the rotary shaft causing the sheet feed roller to rotate and making a first clutch engagement at the time of sheet feeding, disengagement of the clutch at a time T2, when the driving force is transmitted to the inertial member at specified time after the aligning roller is turned on causing specified flexion on the sheet, and making the second engagement of the clutch at a time T4, while the inertial member is continuously rotating.

10. The method according to claim 9, wherein the inertial member is rotating after completing the clutch disengaging until the second clutch engagement is started.

* * * * *